US005598785A

United States Patent [19]

Zaguroli, Jr.

[11] Patent Number: 5,598,785

[45] Date of Patent: Feb. 4, 1997

[54] HANGER BRACKET FOR TRACK RAILS

[75] Inventor: James Zaguroli, Jr., Drayton Plains, Mich.

[73] Assignee: Knight Industries, Inc., Auburn Hills, Mich.

[21] Appl. No.: 554,280

[22] Filed: Nov. 6, 1995

[51] Int. Cl.[6] ..... E01B 25/24

[52] U.S. Cl. ..... 104/111; 16/94 R; 248/223.41; 248/229.24

[58] Field of Search ..... 104/111; 16/87 R, 16/94 R, 96 R; 248/223.41, 229.1, 229.14, 229.2, 229.24

[56] References Cited

U.S. PATENT DOCUMENTS

| | | | |
|---|---|---|---|
| 493,216 | 5/1893 | Louden | 104/111 |
| 1,349,141 | 8/1920 | Neller | 104/111 |
| 1,759,213 | 5/1930 | Webb | 104/111 |
| 2,562,406 | 7/1951 | Barker | 104/111 |
| 3,468,509 | 9/1969 | Foltz | 16/94 R |
| 4,471,867 | 9/1984 | Forshee | 104/111 |
| 4,694,531 | 9/1987 | Foy | 104/111 |

FOREIGN PATENT DOCUMENTS

| | | | |
|---|---|---|---|
| 1071912 | 12/1959 | Germany | 104/111 |

*Primary Examiner*—S. Joseph Morano
*Attorney, Agent, or Firm*—John R. Benefiel

[57] ABSTRACT

A hanger bracket for trolley track rails is constructed of U-shaped formed pieces of sheet metal bolted together to provide both a clamping and a through bolt attachment to a rail mounting flange to simplify installation. The bracket is adapted to a pivot bolt mounting by a removable mounting plate received in slots in the formed pieces. Aligned holes in the formed pieces allow a hanger bar mounting, while the removable plate can also receive a swivel bolt. The formed pieces are interfit to be keyed together to insure shared loading of the rail flanges.

12 Claims, 2 Drawing Sheets

HANGER BRACKET FOR TRACK RAILS

BACKGROUND OF THE INVENTION

This invention concerns hanger supports for track rails. Hoists and other material handling devices are often supported on trolleys running along overhead track rails. Bridging track rails are sometimes used which support the hoists for movement in two directions, the bridge rails themselves movable on trolleys running along parallel line track rails.

The track rails are typically configured with a mounting tee flange at the top of the rail and clamping hanger brackets have been relied on to fix the track rails in position.

Recent safety standards sometimes require bolts extending through the holes in the vertical web of the tee flange. Installation of brackets requiring drilling of holes is more difficult since the bracket must be held during the installation.

Hanger brackets that have been used heretofore have used relatively heavy cast and machined parts, which are costly to fabricate.

Hanger brackets often use separate pieces, each engaging one of the tee flange webs, which can sometimes result in the load being carried by a single flange rather than insuring that the load be shared between both flanges.

A variety of types of support hardware have been used with such hanger brackets. For example, bridge hangers use pivoted posts which allow the ends of bridging track rails to move out of alignment.

Some installations use hanger bars supported on a cross tube received over a bolt passing through the hanger bracket. Other installations use swivel bolts holding a bracket plate.

This has required a variety of hanger bracket configurations, increasing the costs of manufacture.

Accordingly, it is an object of the present invention to provide a hanger bracket for track rails which are able to be conveniently installed in either a clamping or bolted manner.

It is another object of the present invention to provide a common hanger bracket configuration which is adapted to a number of mounting styles and which is constructed of low cost formed sheet material.

Yet another object of the present invention is to provide a hanger bracket which insures shared loading of both sides of the rail tee flange.

SUMMARY OF THE INVENTION

The above-recited objects are accomplished by a hanger bracket comprised of a pair of identical formed U-pieces having sides abutted together and fit to the tee flange. The U-piece sides have interfit complementary portions which key the pieces together to insure a shared loading.

A removable holder plate is received in aligned slots in the U-piece bottom portion, which plate has a central flared hole allowing mounting of a pivot post on a swivel post. The plate can be removed to allow installation of a hanger bar on a cross bolt received in aligned holes in the U-pieces.

The U-pieces also have two sets of aligned bolt holes, allowing an upper set of bolts to clamp the bracket to the tee flange and a lower set to be installed thereafter through drilled holes in a vertical web of the tee flange.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
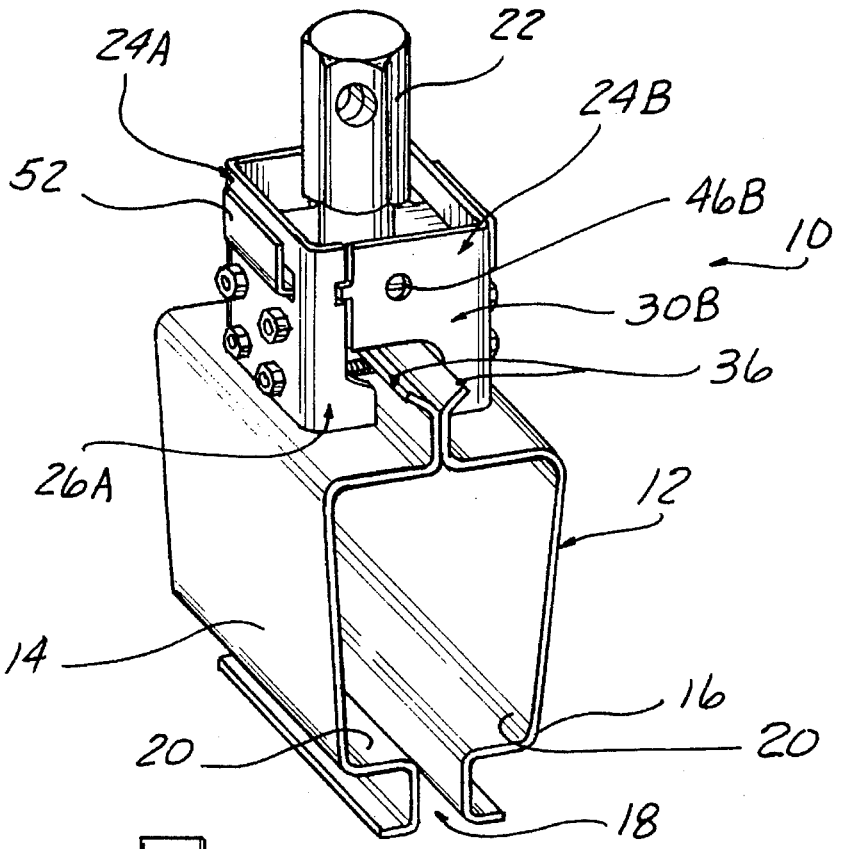
FIG. 1 is a perspective view of a hanger bracket according to the present invention installed on a track rail.

Referring to the drawings, in FIG. 1 the hanger bracket 10 according to the present invention is shown installed on track rail section 12. The track rail section 12 is formed with a pair of hat shaped sections 14, 16 welded together at the top to form a trolley supporting shape, with a space 18 between the bottom flanges allowing a holder part of a trolley (not shown) to project below the track rail 12 as the trolley runs on the horizontal support surfaces 20 formed in the well known manner.

In this installation, the hanger bracket 10 is shown supporting a pivot post 22 used to support bridging track rail 12.

The hanger bracket 10 is comprised of a pair of identical U pieces 24A, 24B preferably formed from heavy gauge sheet steel, pieces 24A, 24B held together in abutment with each other to create a boxed enclosure.

Figure 3:
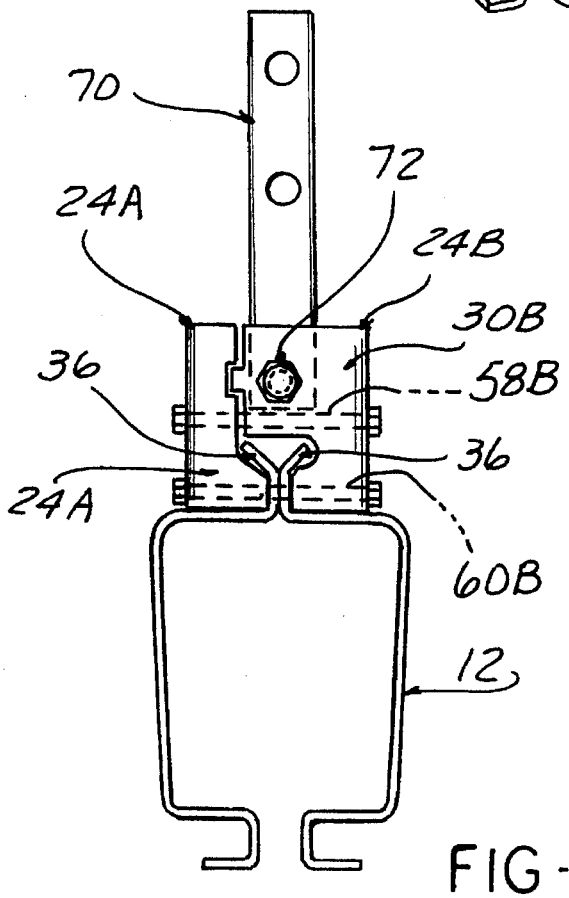
FIG. 3 is an end view of the bracket shown in FIGS. 1 and 2, reconfigured with the holder plate removed and a hanger bar installed instead of a pivot post shown in FIGS. 1 and 2.

Each U piece 24A, 24B has asymmetrically shaped sides 26A, 28A, 26B, 28B joined by a base section 34A, 34B configured to be fit to the tee flanges 36 of the track rail 12, as best seen in FIG. 3, which shows an optional reconfiguration but the same interfitting of the U-form pieces 24A, 24B.

Sides 28A, 28B each have an upper, longer portion 38A, 38B which extend across the center of the formed box enclosure to abut the edge of the other shortened side 40A, 40B of the opposite piece 24A or 24B.

Each longer upper portion 38A, 38B is formed with a key feature 42A, 42B aligned and interfit with a slot 44A, 44B of the abutting short side 40A, 40B.

The lower portions of both sides 26A, 28A, 26B, 28B are symmetrically shaped to together create an opening to receive the tee flanges 36 and enable clamping thereto when the pieces 24A, 24B are bolted together.

Each longer upper portion 38A, 38B is also formed with a hole 46A, 46B which are aligned above the top of the flanges 36 when the pieces 24A, 24B are assembled.

Base portions 34A, 34B are also each formed with a horizontal slot 48A, 48B, aligned with each other when the pieces 24A, 24B are assembled.

Figure 2:
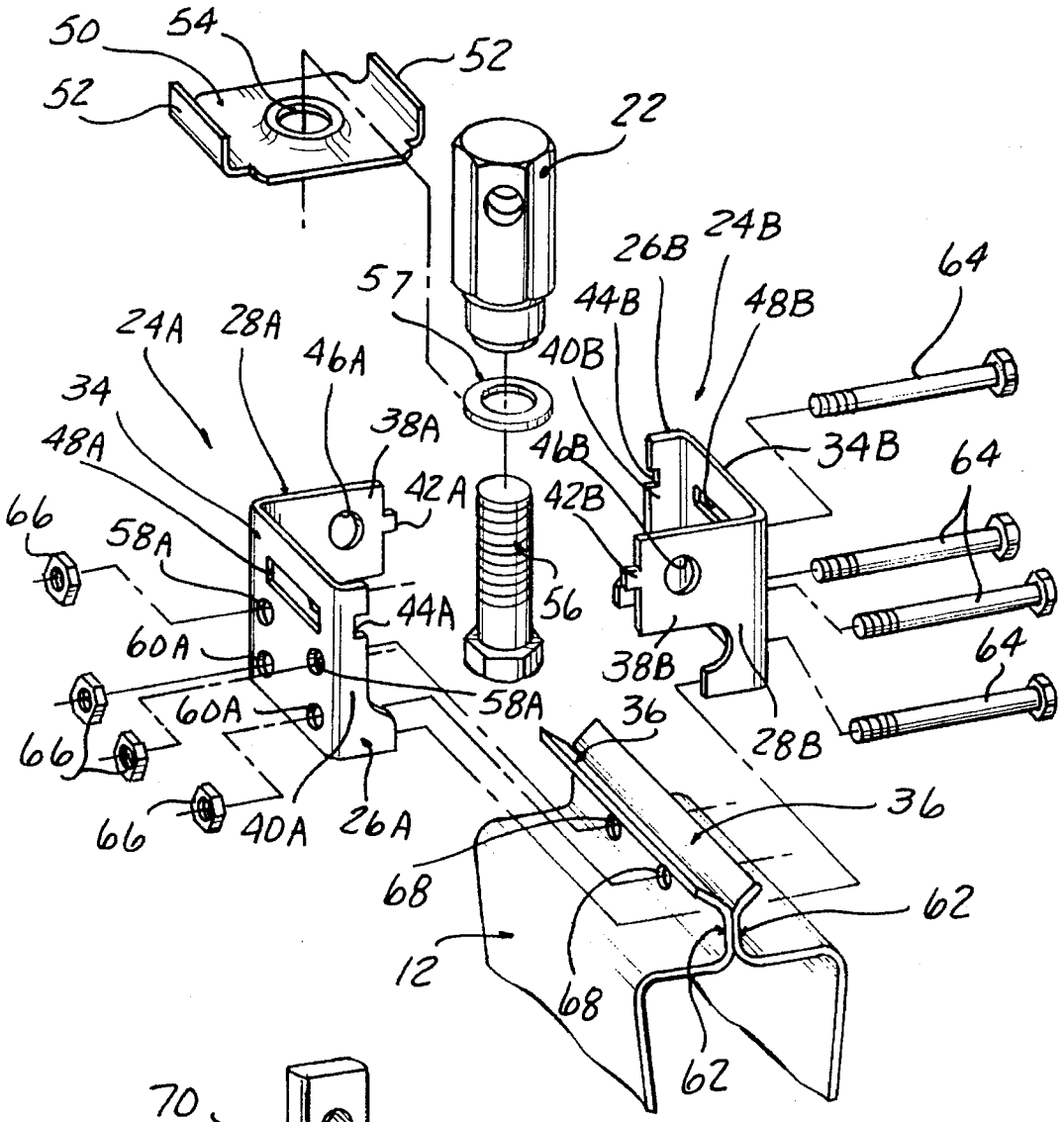
FIG. 2 is an exploded perspective view of the hanger bracket and track rail section shown in FIG. 1.

A removable mounting plate 50 has upturned ends 52 which are received in the slots 48A, 48B and retained therein to position the mounting plate 50 horizontally. A central upwardly flared mounting hole 54 is provided to receive pivot post 22 held with bolt 56 in the configuration of FIGS. 1 and 2, with a thrust bearing 57 allowing turning of the pivot post 22.

Each base 34A, 34B is also formed with pairs of holes 58A, 60A, 58B, 60B which are located at two different levels, the upper holes 58A, 58B aligned above the level of the tee flange 36, and the lower holes 60A, 60B aligned with the center of the vertical webs 62.

At assembly, a set of elongated fastener bolts 64 can be assembled in the upper holes 58A, 58B and retained with nuts 66. Thereafter, the bracket 10 can be conveniently aligned with holes 68 predrilled in the webs 62 and a second set of bolts 64 installed.

Alternatively, clamping only can be used where appropriate by using bolts 64 in the upper holes 58A, 58B only.

Figure 4:
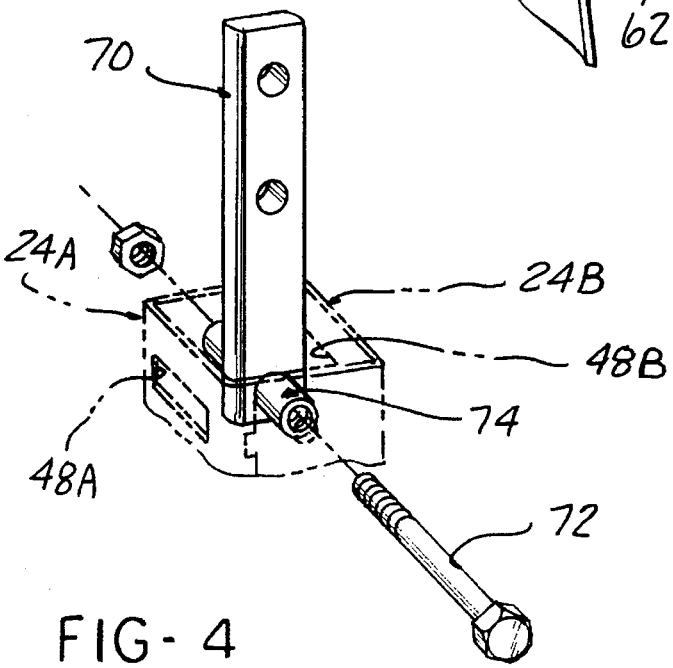
FIG. 4 is an exploded fragmentary perspective view of the hanger bar and bracket shown in FIG. 3.

To adapt the bracket 10 to a hanger bar 70, plate 50 is removed and a bolt 72 passed through a mounting cross tube 74 welded to the bar 70 and aligned with holes 46A, 46B, as shown in FIGS. 3 and 4.

Figure 5:
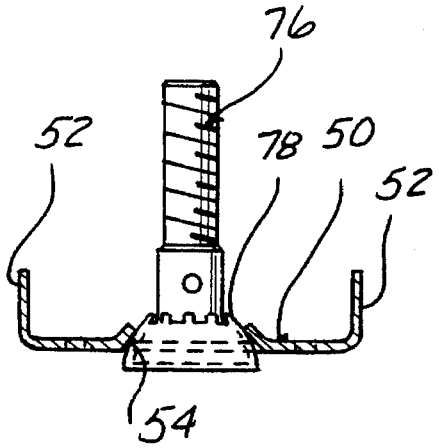
FIG. 5 is a sectional view of a holder plate with a swivel bolt installed therein.

FIG. 5 shows a swivel bolt 76 having a swivel head 78 received in the plate 50, the flared hole 54 allowing tilting adjustment.

Accordingly, the same hanger bracket 10 of the present invention is adaptable to various mounting arrangements and is constructed of an assembly of low cost formed parts. The load is shared between the bracket pieces to insure that support is provided by both sides of the tee flange.

Finally, installation is simplified as both a clamped and through bolt attachment is provided.

I claim:

1. A trolley track rail and hanger system comprising:

a generally horizontally extending trolley track rail having a mounting tee flange comprised of a vertical web and oppositely extending flange sides;

a hanger bracket including a pair of U-shaped formed pieces, each having a pair of spaced apart vertical sides and a base portion connecting said vertical sides, such that said formed pieces comprise vertically oriented channels, vertical edges on the end of an upper portion of each of said pair of vertical sides of one piece in abutment with respective vertical edges on the end of an upper portion of each of said pair of sides of the other piece to form an open-topped boxed enclosure, a lower portion of each of said pairs of vertical sides cut away so as to be configured to be fit to said tee flange vertical web by lower portions of each of said pairs of sides extending beneath said flange sides, and defining a space for said vertical web, said formed pieces held together with said upper portions of said side edges in abutment by elongated fasteners extending across said tee flange through said base portion of each formed piece.

2. The system according to claim 1 wherein two sets of elongated fasteners are provided, one set located at a level passing through holes in said tee flange web, another set located at a level passing above said tee flange sides.

3. The system according to claim 1 wherein said hanger bracket further includes a removable mounting plate having ends received in a pair of aligned horizontal slots, each slot of said pair formed in a respective base portion of one of said formed pieces, said mounting disposed in said open top of said boxed enclosure.

4. The system according to claim 3 wherein said mounting plate ends are bent upwardly at a location beyond said respective base portion to retain said mounting plate ends in said slots.

5. The system according to claim 3 wherein said mounting plate has a central mounting hole formed therein.

6. The system according to claim 5 wherein said mounting hole is flared to mate with a swivel bolt.

7. The system according to claim 1 wherein an upper portion of each of said pair of sides is formed asymmetrically with one upper portion in each pair of sides extending across a center of said boxed enclosure, the other side in each pair correspondingly shorter in length, each longer upper portion abutting a shorter upper portion of the opposite formed piece.

8. The system according to claim 7 wherein each longer upper portion is formed with a hole aligned with the hole of the upper portion of one of the sides of the other formed piece.

9. The system according to claim 7 wherein said upper portions of said pair of sides of each formed piece are each positively interfit with an abutting shorter length upper portion of a side of the other formed piece to be keyed together to insure shared loading of each tee flange side.

10. The system according to claim 7 wherein said boxed enclosure has a pair of openings in said boxed enclosure located across from each other with respect to said enclosure adjacent the top thereof;

a hanger member having opposite ends inserted in each of said openings to be supported thereby; and, a bracket hanger element supported by said hanger member.

11. The system according to claim 7 wherein each of said pieces is identically shaped to the other piece so as to be interchangeable.

12. The system according to claim 1 wherein said U pieces are formed from sheet steel.

* * * * *

UNITED STATES PATENT AND TRADEMARK OFFICE

CERTIFICATE OF CORRECTION

PATENT NO. : 5,598,785
DATED : February 4, 1997
INVENTOR(S) : James Zaguroli, Jr.

It is certified that error appears in the above-indentified patent and that said Letters Patent is hereby corrected as shown below:

Column 2, line 56, "are" should be --is--.

Signed and Sealed this

First Day of April, 1997

*Attest:*

BRUCE LEHMAN

*Attesting Officer*

*Commissioner of Patents and Trademarks*